US007052477B2

(12) United States Patent
Wu et al.

(10) Patent No.: US 7,052,477 B2
(45) Date of Patent: May 30, 2006

(54) STEERING MECHANISM OF A MASSAGE MACHINE

(76) Inventors: Dong-Her Wu, No. 141, Sec. 2, Chang Shui Road, Pu Yen Hsiang, Chang Hua Hsien (TW); Lai-Fu Tang, No. 112, Lane 80, Jianping 6th Street, Anping District, Tainan City (TW)

( * ) Notice: Subject to any disclaimer, the term of this patent is extended or adjusted under 35 U.S.C. 154(b) by 335 days.

(21) Appl. No.: 10/683,989

(22) Filed: Oct. 14, 2003

(65) Prior Publication Data

US 2005/0080365 A1 Apr. 14, 2005

(51) Int. Cl.
*A61H 15/00* (2006.01)

(52) U.S. Cl. ..... 601/99; 601/98; 601/103; 601/116

(58) Field of Classification Search ..... 601/97, 601/98, 99, 101–103, 112, 115, 116, 122, 601/126, 90–95
See application file for complete search history.

(56) References Cited

U.S. PATENT DOCUMENTS

| | | | | |
|---|---|---|---|---|
| 2,827,044 | A * | 3/1958 | Orthwine | 601/99 |
| 6,039,705 | A * | 3/2000 | Wu | 601/99 |
| 6,196,983 | B1 * | 3/2001 | Wu | 601/99 |
| 6,402,709 | B1 * | 6/2002 | Wu | 601/98 |
| 6,409,689 | B1 * | 6/2002 | Chen | 601/99 |
| 6,840,914 | B1 * | 1/2005 | Takamura | 601/99 |

* cited by examiner

*Primary Examiner*—Quang D. Thanh
(74) *Attorney, Agent, or Firm*—Alan D. Kamrath; Nikolai & Mersereau, P.A.

(57) ABSTRACT

A massaging machine includes a massaging device and a steering mechanism for operating the massaging device. The steering mechanism has a shaft on which a drive gear and a driven seat are mounted. The drive gear is driven by a motor to actuate the massaging device to operate. The driven seat is provided with a unidirectional bearing by which the driven seat is mounted on the shaft. The unidirectional bearing is intended to disable the massaging device to engage in a reciprocating motion at the time when the drive gear is driven to turn in a reverse direction.

3 Claims, 5 Drawing Sheets

STEERING MECHANISM OF A MASSAGE MACHINE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a massaging machine, and more particularly to a steering mechanism of the massaging machine.

BACKGROUND OF THE INVENTION

The conventional steering mechanism of the massaging machine comprises a gear, confining slot, insertion pin, fly wheel, arresting gear, etc. The conventional steering mechanism is complicated in construction and is therefore not cost-effective, thereby resulting in high production cost of the massaging machine.

BRIEF SUMMARY OF THE INVENTION

The primary objective of the present invention is to provide a massaging machine with a cost-effective steering mechanism comprising a shaft, a drive gear, a driven seat, an auxiliary gear, and a unidirectional bearing. The drive gear is mounted on the shaft and is engaged with a worm driven by a motor. The auxiliary gear is fastened with the driven seat which is mounted on the shaft in conjunction with the unidirectional bearing. The drive gear is provided with a master gear which is linked with a slave gear of the massaging device of the massaging machine by a chain. The auxiliary gear is engaged with a transmission gear, so as to enable the massaging device to move in a reciprocating manner. The shaft of the steering mechanism of the present invention is formed of a core and a wear-resistant sleeve fitted over the core. The drive gear and the unidirectional bearing of the driven seat are mounted on the wear-resistant sleeve of the shaft.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
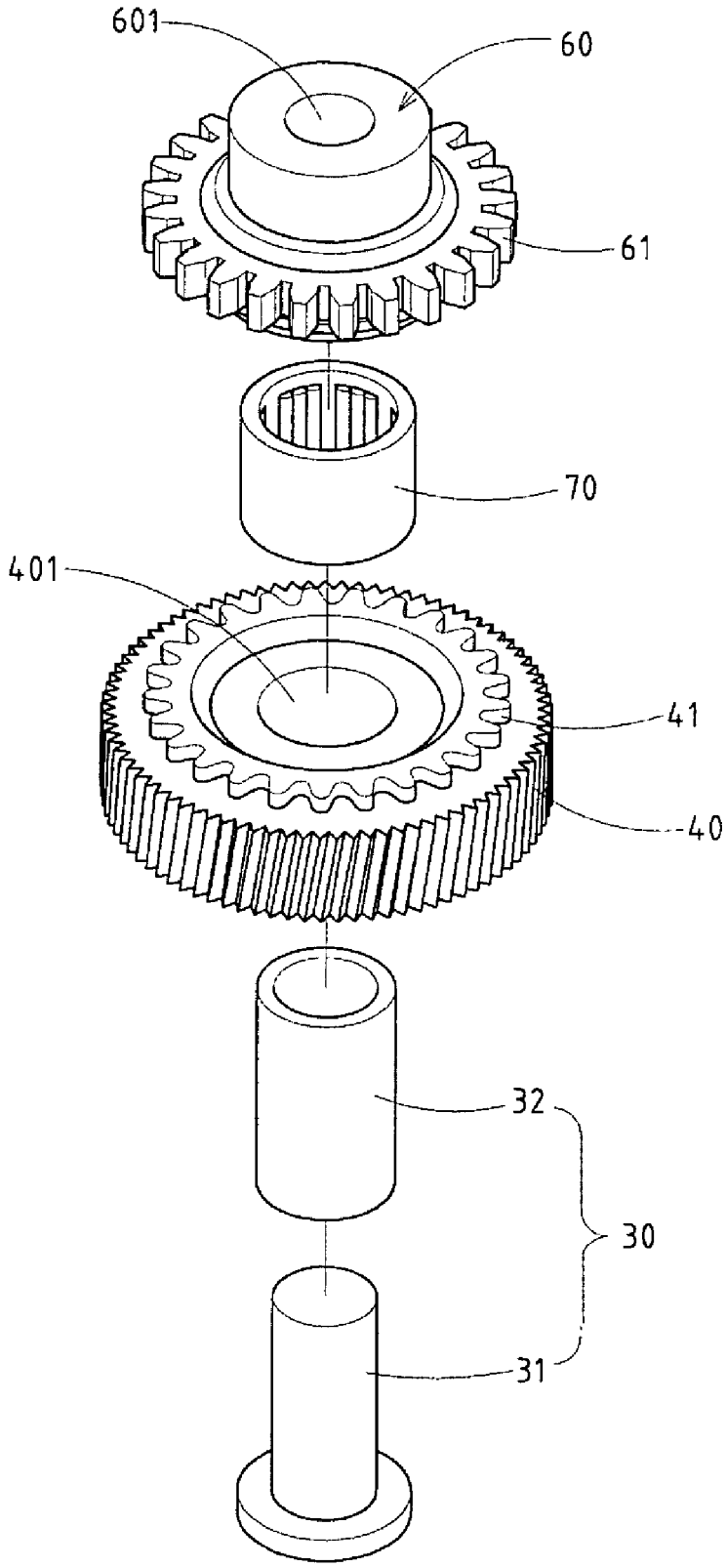
FIG. 1 shows an exploded view of the preferred embodiment of the present invention.
Figure 2:
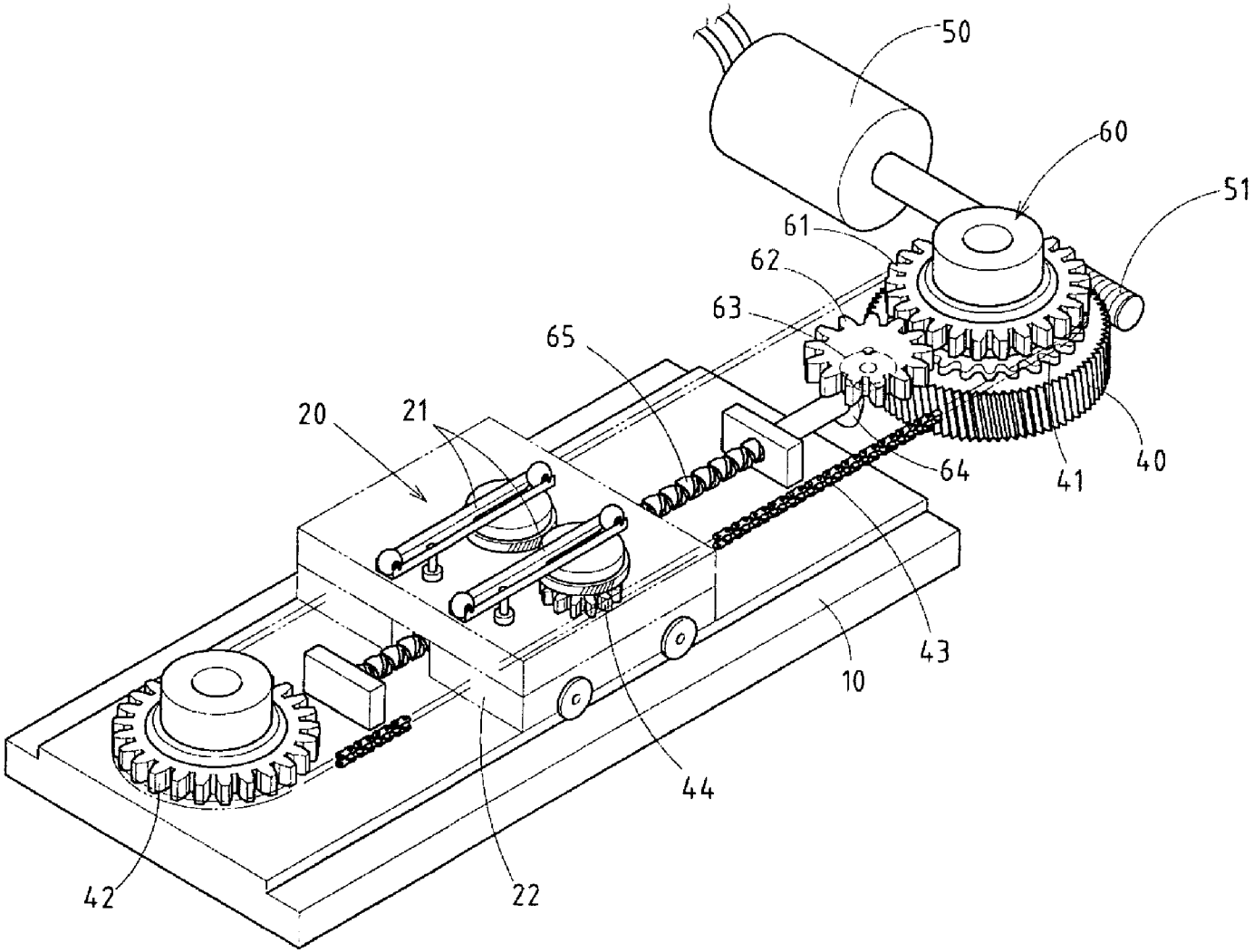
FIG. 2 shows a schematic view of the structure of a massaging machine comprising the steering mechanism of the present invention.
Figure 3:
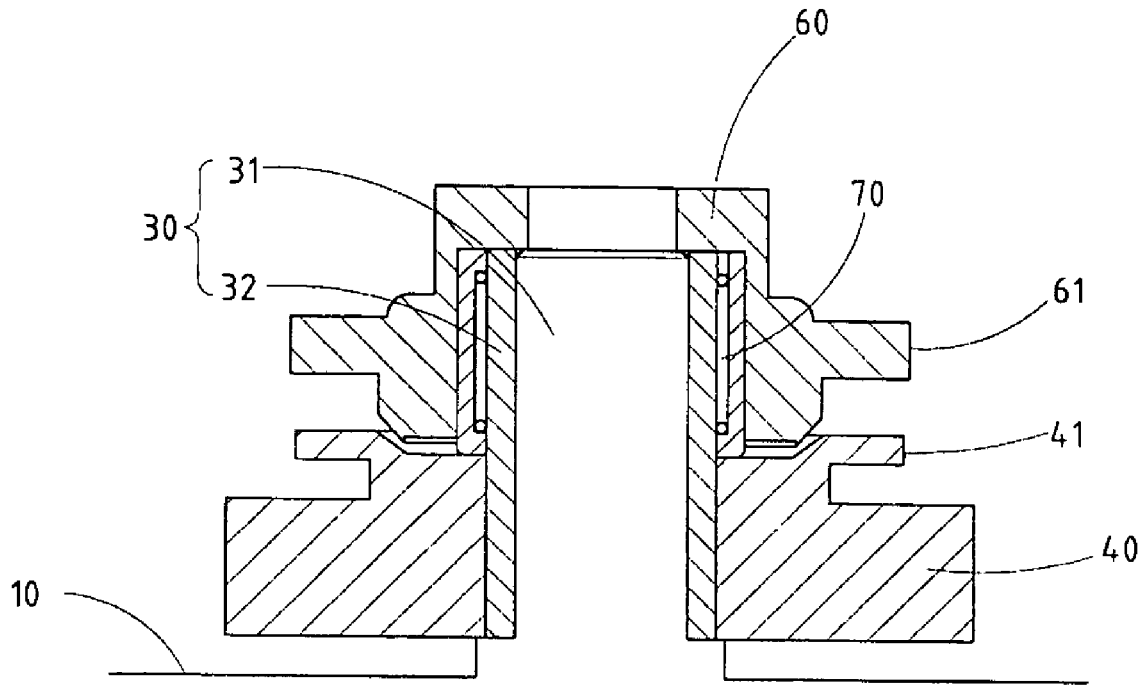
FIG. 3 shows a sectional schematic view of the preferred embodiment of the present invention in combination.

As shown in FIGS. 1–3, a steering mechanism embodied in the present invention comprises a shaft 30, a drive gear 40, and a driven seat 60. The steering mechanism of the present invention is used to steer a massaging device 20 which is mounted on a base 10 of a massaging machine.

The driven gear 40 is provided with a center hole 401 and a master gear 41. The center hole 401 is used to mount the drive gear 40 on the shaft 30 such that the drive gear 40 is engaged with a worm 51 driven by a motor 50, and that the master gear 41 is linked with a slave gear 42 by a chain 43 which is engaged with a gear 44 of two massaging members 21 of the massaging device 20.

The driven seat 60 is provided with an auxiliary gear 61, and a fitting hole 601 by which the driven seat 60 is mounted on the shaft 30 such that the auxiliary gear 61 is engaged with a transmission gear 62 which actuates a bidirectional threaded rod 65 via two sector gears 63 and 64. As the bidirectional threaded rod 65 is actuated, a mounting seat 22 of the massaging device 20 is driven to move in a reciprocating manner.

The steering mechanism of the present invention is characterized by the shaft 30 and the driven seat 60. The shaft 30 is formed of a core 31 and a wear-resistant sleeve 32 fitted over the core 31. The driven seat 60 is provided in the fitting hole 601 thereof with a unidirectional bearing 70. The drive gear 40 is mounted on the wear-resistant sleeve 32 of the shaft 30, whereas the driven seat 60 is mounted on the wear-resistant sleeve 32 of the shaft 30 in conjunction with the unidirectional bearing 70.

Figure 4:
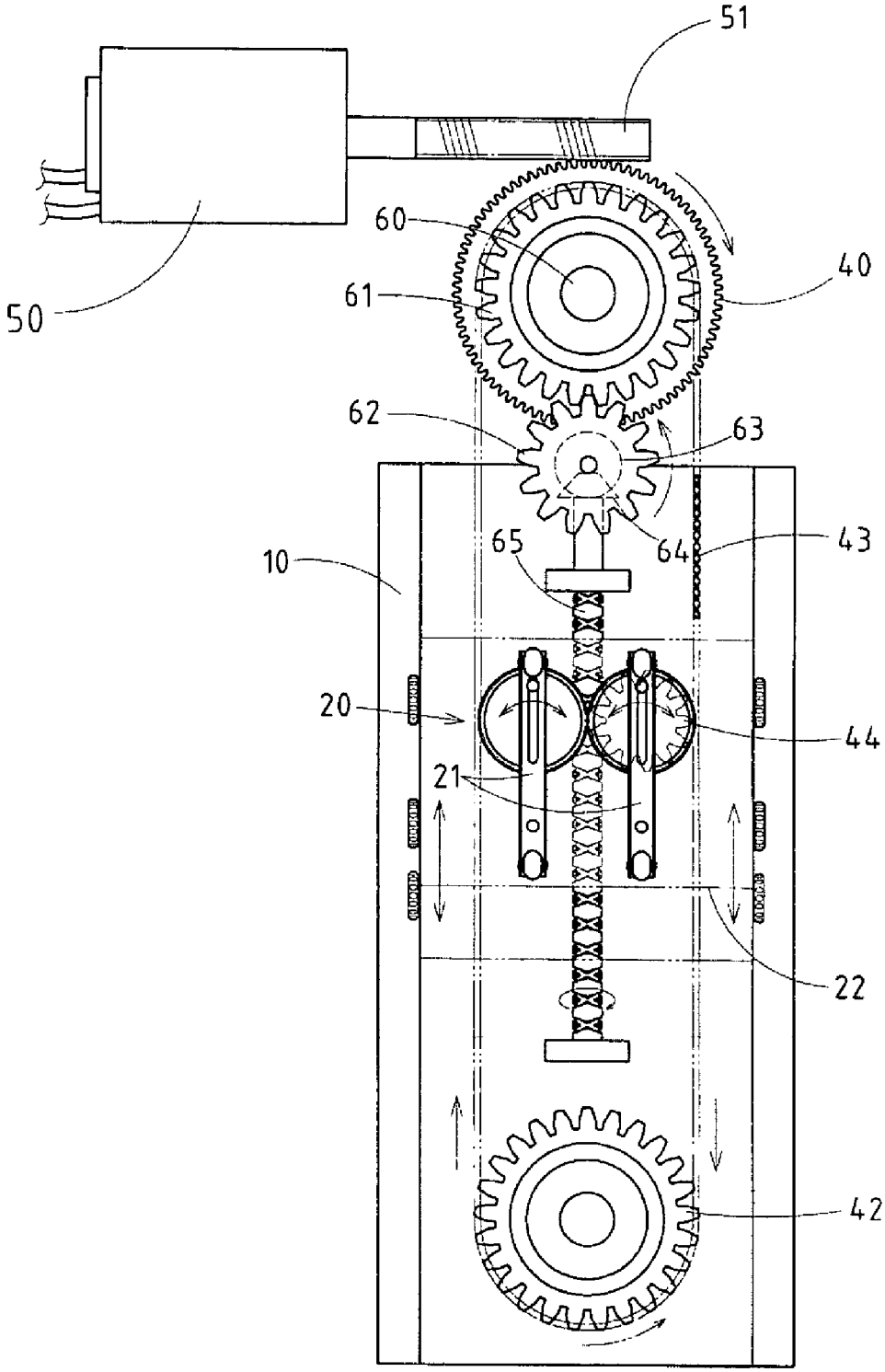
FIG. 4 shows a schematic plan view of the preferred embodiment of the present invention in action to enable the massaging machine to engage in a reciprocating operation.

As illustrated in FIG. 4, when the drive gear 40 turns in a forward direction, the massaging members 21 of the massaging device 20 are driven to operate via the chain 43 and the gears 44. Meanwhile, the driven seat 60 and the bidirectional threaded rod 65 are actuated via the unidirectional bearing 70, thereby resulting in a reciprocating motion of the massaging device 20.

Figure 5:
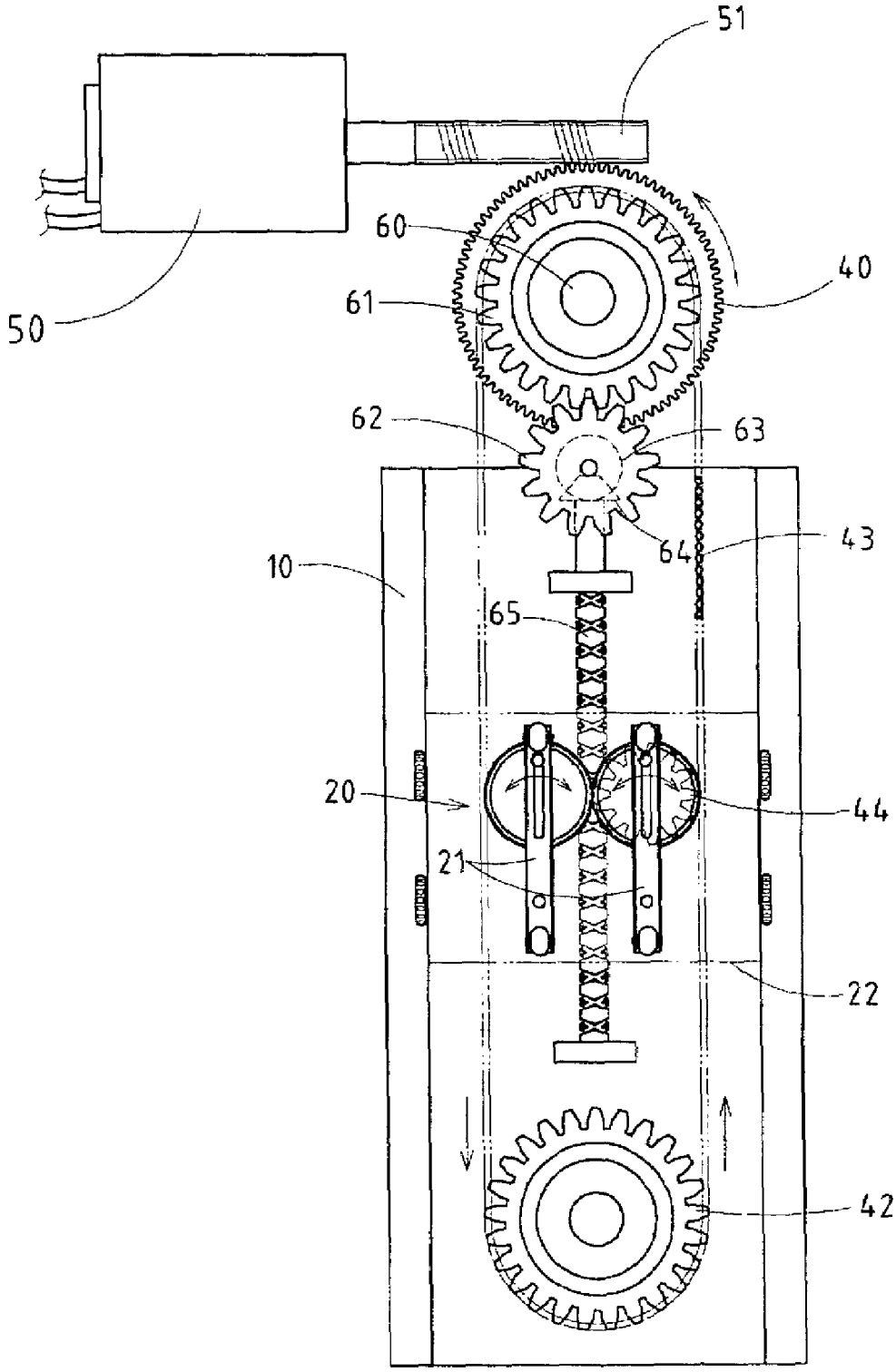
FIG. 5 shows a schematic plan view of the preferred embodiment of the present invention in action to enable the massaging machine to engage in a fixed point operation.

As illustrated in FIG. 5, when the drive gear 40 turns in a reverse direction, the massaging members 21 of the massaging device 20 are actuated to operate via the chain 43 and the gears 44. However, the massaging device 20 operates at a fixed point in view of the fact that the driven seat 60 and the bidirectional threaded rod 65 are not actuated by the unidirectional bearing 70. In another words, the massaging device 20 is incapable of the reciprocating motion.

The embodiment of the present invention described above is to be regarded in all respects as being illustrative and nonrestrictive. Accordingly, the present invention may be embodied in other specific forms without deviating from the spirit thereof. The present invention is therefore to be limited only by the scopes of the following claims.

We claim:

1. A steering mechanism of a massaging machine, said steering mechanism serving to actuate a massaging device of the massaging machine to operate and to move in a reciprocating manner, said steering mechanism comprising:

a shaft;

a drive gear comprised of a master gear and mounted on said shaft such that said drive gear is engaged with a worm of a motor, and such that said master gear is linked with a slave gear of the massaging machine by a chain which is used to actuate the massaging device to operate; and a driven seat comprised of an auxiliary gear and mounted on said shaft such that said auxiliary gear is engaged with a transmission gear serving to actuate a bidirectional threaded rod via two sector gears, thereby resulting in a reciprocating motion of the massaging device;

wherein said driven seat is comprised of a unidirectional bearing and is mounted on said shaft by said unidirectional bearing whereby said unidirectional bearing serves to disable the massaging device to engage in the reciprocating motion at the time when said drive gear is driven to turn in a reverse direction.

2. The steering mechanism as defined in claim 1, wherein said shaft is comprised of a core and a wear-resistant sleeve fitted over said core.

3. The steering mechanism as defined in claim 2, wherein said drive gear is mounted on said wear-resistant sleeve of said shaft; wherein said unidirectional bearing of said driven seat is mounted on said wear-resistant sleeve of said shaft.

* * * * *